United States Patent [19]

Dummer

[11] 3,961,146

[45] June 1, 1976

[54] PRETRAVEL SWITCH FOR PORTABLE TOOLS

[75] Inventor: Merlin R. Dummer, Arab, Ala.

[73] Assignee: Cutler-Hammer, Inc., Milwaukee, Wis.

[22] Filed: Oct. 9, 1974

[21] Appl. No.: 513,249

[52] U.S. Cl. ..... 200/157; 200/153 V

[51] Int. Cl.[2] ..... H01H 13/08

[58] Field of Search ..... 200/157, 153 V, 153 R, 200/159 R, 329

[56] References Cited

UNITED STATES PATENTS

| | | | |
|---|---|---|---|
| 3,485,975 | 12/1969 | Long | 200/153 V X |
| 3,646,298 | 2/1972 | Weber et al. | 200/153 V X |
| 3,673,365 | 6/1972 | Schadow | 200/153 V X |
| 3,766,348 | 10/1973 | Johnson | 200/157 |
| 3,773,997 | 11/1973 | Evans et al. | 200/153 V X |
| 3,790,730 | 2/1974 | Wyland | 200/153 V |

*Primary Examiner*—Herman Hohauser
*Attorney, Agent, or Firm*—H. R. Rather; Wm. A. Autio

[57] ABSTRACT

A trigger switch for a portable electric tool providing substantial pretravel of the trigger before closing force is applied to the contacts. This is a safety measure to prevent the motor from starting if the trigger should be accidentally pressed in handling a circular saw or the like. The pretravel is provided by a telescopic joint between the trigger and contact carrier, each of which is biased independently by a return spring to insure immediate reopening of the contacts upon release of the trigger.

11 Claims, 5 Drawing Figures

PRETRAVEL SWITCH FOR PORTABLE TOOLS

BACKGROUND OF THE INVENTION

Switches of the trigger type have been known heretofore. However, these switches have generally included a direct connection between the operating member and the movable contact causing actuation of the contacts toward closing immediately upon movement of the trigger. This subjects the switch to accidental closure when a portable tool is being handled.

Switches of the preloading, free play or lost motion type have also been known. Such preloading has been used in switches of the toggle lever or push-button type or the like for snap-action purposes. Thus, initial movement of the operating member causes compression or preloading of a spring while the movable contact is held by a spring-biased detent and, when the preloading overcomes the restraining action of detent, the switch snaps to its operating position. Free play has been used to impart an impact force or so-called "hammer blow" to aid in opening partially welded contacts, a very short free play being generally sufficient therefor. Lost motion has been used for overtravel purposes and the like when the thing that operates the switch must be allowed to keep moving after the switch has been operated thereby to avoid damaging the switch.

While these prior switches have been useful for their intended purposes, this invention has a different purpose, that is, to prevent accidental closure of the switch.

SUMMARY OF THE INVENTION

This invention relates to pretravel switches for portable tools. While not limited thereto, the invention is especially applicable to trigger switches to prevent accidental closure of the switch contacts while the tool is being handled.

An object of the invention is to provide an improved pretravel switch allowing substantial movement of the operating member before closing force is applied to the contacts.

A more specific object of the invention is to provide an improved pretravel structure allowing substantial switch operator movement before closing force is applied to the contact carrier on switch closing and insuring that on switch reopening the contact carrier moves first to open the contacts followed by restoration of the switch operator to its full off position.

Another object of the invention is to provide an improved pretravel trigger switch.

Another specific object of the invention is to provide such trigger switch with independent biasing means for the trigger and contact carrier for improved operation.

Other objects and advantages of the invention will hereinafter appear.

DESCRIPTION OF THE PREFERRED EMBODIMENT

Figure 1:
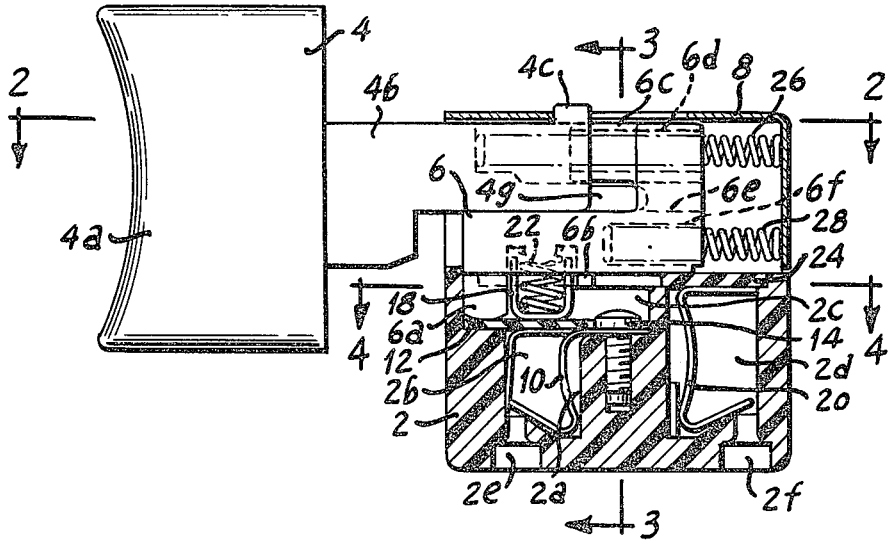
FIG. 1 is an enlarged vertical cross-sectional view of a pretravel trigger switch, this view being taken substantially along line 1—1 as indicated in FIG. 3.

Referring to the drawing, there is shown a pretravel trigger switch constructed in accordance with the invention. This switch comprises an insulating base 2, an insulating switch operating member such as a trigger 4, an insulating contact carrier 6, and a frame 8 of metal or other suitable material for retaining the trigger and contact carrier slidably on top of the base.

Figure 3:
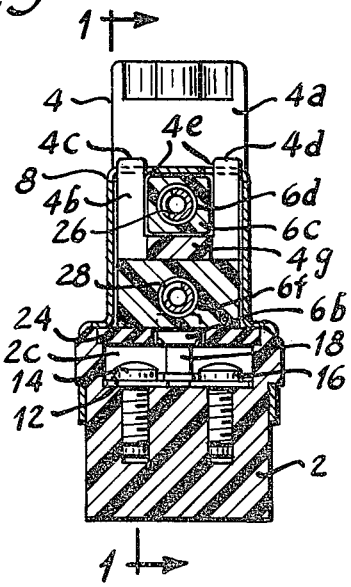
FIG. 3 is a vertical cross-sectional view taken along line 3—3 of the switch of FIG. 1 to show the pretravel structure and the stationary contacts.
Figure 4:
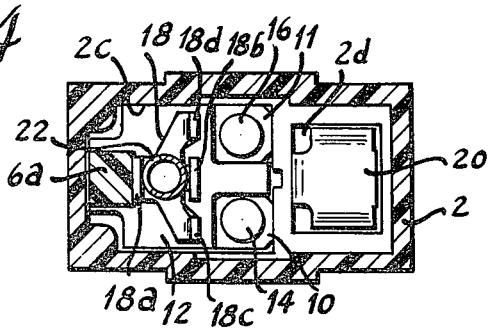
FIG. 4 is a horizontal cross-sectional view taken along line 4—4 of the switch of FIG. 1 to show a top view of the switch contacts.

The base is made of molded, electrically insulating material and is generally rectangular in shape as shown in FIGS. 1, 3 and 4. The base is provided with four compartments. These compartments include a pair of side-by-side forward compartments for housing a pair of terminal clips, the left one 2*a* of these compartments and the left and right terminal clips 10 and 11 being shown in FIGS. 1 and 4. These compartments and terminals clips are similar and are separated by a vertical dividing wall 2*b* integral with the base.

These compartments also include a contact compartment 2*c* overlying the aforementioned pair of terminal clip compartments and separated therefrom by an insulator plate 12 shown in top view in FIG. 4. This compartment houses stationary contacts 14 and 16 and movable bridging contact 18.

These compartments further comprise a rear compartment 2*d* for housing a bussing clip 20 as shown in FIGS. 1 and 4.

As shown in FIGS. 1, 3 and 4, stationary contact means including contacts 14 and 16 extend through holes in the folded-back stems of terminal clips 10 and 11, respectively, and are threaded into holes in the base to secure the terminal clips in their respective compartments. The spherical segments on the heads of the stationary contacts extend slightly above insulator plate 12 so that the movable bridging contact can be slid thereon to electrically bridge the stationary contacts. Two adjacent holes 2*e*, one of which is shown in FIG. 1, extend through the bottom of the base into each of the forward, terminal clip compartments so that one or two bare-ended conductors can be pushed in to connect to the corresponding stationary contact.

Three holes 2*f*, one of which is shown in FIG. 1, extend up through the bottom of the base into rear compartment 2*d* and bussing clip 20 is a wide clip as shown in FIG. 4 so that two or three stripped wires can be pushed thereinto to connect them to one another through the clip.

Figure 5:
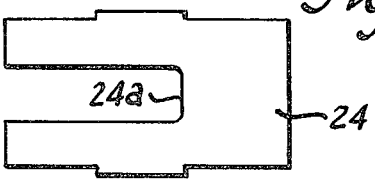
FIG. 5 is a top view of the insulator plate located at the top of the base in FIGS. 1 and 3.

Movable bridging contact 18 is shown in FIGS. 1, 3 and 4. This movable contact has a pair of upstanding arms 18*a* and 18*b* arranged forwardly-rearwardly as shown in FIGS. 1 and 4 that extend up into a slot in the bottom of contact carrier 6. This slot also accommodates a helical compression spring 22 that biases the movable contact down for proper contact pressure when the switch is closed. By the aforesaid upstanding arms, the movable contact is coupled to the contact carrier for rearward-forward sliding movement therewith. This movable contact also has a pair of lateral wings 18*c* and 18*d* extending in opposite directions and having upturned rear edges as shown in FIG. 4 so that they will slide onto the stationary contacts when the trigger is pulled back. To assist in moving the movable contact, the contact carrier is provided with a downward projection 6*a* immediately in front of the movable contact, this projection sliding along insulator plate 12. Another short projection 6*b* extends down from the contact carrier directly behind the movable contact as shown in FIGS. 1 and 3. This projection serves with forward projection 6*a* not only to retain the movable contact on the contact carrier but also to limit the rearward movement of the contact carrier by stopping against the rear end of slot 24*a* in insulator plate 24. As will be apparent, this insulator plate shown in FIGS. 1, 3 and 5 closes the open top of the base except for this slot 24*a* that provides clearance for reciprocal movement of the movable contact.

Figure 2:
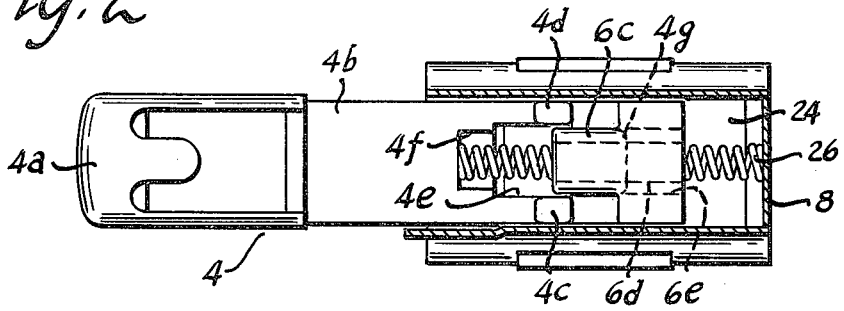
FIG. 2 is a horizontal cross-sectional view taken substantially along line 2—2 of the switch of FIG. 1 to show a top view of the pretravel structure.

Trigger 4 is provided with a forward finger-engaging portion 4*a* and a rearwardly extending slidable portion 4*b* as shown in FIGS. 1–3. This slidable portion is coupled to contact carrier 6 with allowance for pretravel as hereinafter described. The upper surface of the rear end of this slidable portion is provided with a pair of spaced short projections 4*c* and 4*d* extending up through rectangular holes in the frame as shown in FIGS. 1 and 3. These projections not only guide the trigger in its sliding movement but also limit its forward travel.

The aforesaid pretravel coupling between the trigger and contact carrier is provided by a telescopic connection therebetween. As shown in FIG. 2, the trigger is provided with a square recess 4*e* extending forward from its rear end and extending down from its upper surface. This recess snugly receives a complementary square projection 6*c* extending forward from the upper-rear portion of the contact carrier. A recess 4*f* extends from recess 4*e* forward slightly further into the trigger as shown in FIG. 2 to receive the forward end of trigger return spring 26. This spring is a helical compression spring and extends also through the contact carrier to abut at its rear end the rear inner wall of frame 8 as shown in FIG. 1. For this purpose, a round hole 6*d* extends through projection 6*c* and the upper rear part of the contact carrier freely to accommodate spring 26.

The aforesaid telescopic connection also includes sliding surfaces on the trigger and contact carrier. Thus, the lower surface of slidable rear portion 4*b* of the trigger slides on the upper surface of the forward-central portion of the contact carrier.

In addition, the rear end of the trigger is provided with a rearwardly extending flat tongue 4*g* that extends into a complementary flat hole 6*e* extending through the rear portion of the contact carrier directly below trigger return spring hole 6*d* as shown in FIGS. 1 and 2. This tongue and hole 6*e* provide added stability between the trigger and contact carrier after the trigger has been depressed enough to take up the pretravel thereby to insure easy gliding movement of the trigger and contact carrier in unison to close the contacts without any binding or sticking.

The contact carrier is provided with its independent return spring 28. For this purpose, a round hole 6*f* shown in FIGS. 1 and 3 extends from the rear end of the contact carrier forwardly partway thereinto. The forward end of helical compression spring 28 is held in this hole and its rear end abuts the inner rear wall of the frame below spring 26 as shown in FIG. 1.

The pretravel mechanism operates as follows. When the operator pulls back on the trigger, return spring 26 is compressed and the trigger slides on the contact carrier with tongue 4*g* sliding into hole 6*e* and projection 6*c* sliding into recess 4*e*. When the rear end of the trigger abuts the contact carrier, the pretravel has been taken up. Typically, this pretravel is of sufficient magnitude when added to the required movement of the contact carrier before the contacts touch of about a quarter inch (6.35 millimeters) to afford assurance under normal conditions of preventing turn-on of the portable saw when it is being handled. Further depression of the trigger causes movement of the contact carrier to slide the movable bridging contact across the stationary contacts. Trigger movement stops when downward projection 6*b* abut the rear end of slot 24*a* in insulator plate 24 as hereinbefore mentioned.

When the trigger is released, spring 26 pushes the trigger and spring 28 pushes the contact carrier which in turn pushes the trigger. Thus, the contact carrier and trigger move in unison forwardly to open the contacts. When downward projection 6*a* of the contact carrier abuts the front inner wall of the base, the contact carrier stops. However, return spring 26 continues to move the trigger forward until upper projections 4*c* and 4*d* of the trigger abut the front ends of the rectangular holes in the frame thereby to stop the trigger in its off position shown in FIG. 1.

While the apparatus hereinbefore described is effectively adapted to fulfill the objects stated, it is to be understood that the invention is not intended to be confined to the particular preferred embodiment of pretravel switch for portable tools disclosed, inasmuch as it is susceptible of various modifications without departing from the scope of the appended claims.

I claim:

1. A self-enclosed electric switch comprising:

a switch housing including an insulating base;

stationary contact means mounted in said base;

a movable contact arranged to be moved into and out of contact with said stationary contact means;

a contact carrier having a normal off position and being coupled to said movable contact;

a switch operator having a normal off position and being actuatable to move said contact carrier into an on position wherein said movable contact engages said stationary contact means;

means in said switch housing mounting said switch operator and said contact carrier for limited movements on said base;

first biasing means biasing said contact carrier with respect to said housing into its off position;

second biasing means biasing said switch operator with respect to said housing into its off position;

and pretravel coupling means between said switch operator and said contact carrier affording substantial pretravel of said switch operator before applying closing force to said contact carrier when said switch operator is actuated toward its on position.

2. An electric switch comprising:

an insulating base;

stationary contact means mounted in said base;

a movable contact arranged to be moved into and out of contact with said stationary contact means;

a contact carrier having a normal off position and being coupled to said movable contact;

a switch operator having a normal off position and being actuatable to move said contact carrier into an on position wherein said movable contact engages said stationary contact means;

means mounting said switch operator and said contact carrier for movement on said base;

first biasing means biasing said contact carrier into its off position;

second biasing means biasing said switch operator into its off position;

and pretravel coupling means between said switch operator and said contact carrier affording substantial pretravel of said switch operator before applying closing force to said contact carrier when said switch operator is actuated toward its on position;

said pretravel coupling means comprising an abutment on said contact carrier engaged by said switch operator after initial movement of the latter whereafter said switch operator moves said contact carrier.

3. The electric switch defined in claim 2, wherein:

said second biasing means comprises a compression spring normally maintaining said switch operator spaced from said abutment a distance to afford sufficient pretravel to avoid accidental engagement between said movable contact and said stationary contact means.

4. The electric switch defined in claim 2, wherein:

said second biasing means comprises a compression spring normally maintaining said switch operator spaced from said abutment a distance to afford together with the closing movement of the movable contact sufficient pretravel to prevent accidental closure of said movable contact with said stationary contact means.

5. The self-enclosed electric switch defined in claim 1, wherein:

said pretravel coupling means comprises a telescopic joint affording limited movement of said switch operator alone against said second biasing means followed by movement of said switch operator and said contact carrier in unison against both said first and second biasing means when said switch operator is actuated toward contact closure.

6. A pretravel switch for a portable tool to prevent accidental closure of the switch contacts when the tool is being handled comprising:

a housing comprising an insulating base;

stationary contacts mounted in said base and terminals for connecting said contacts to an external circuit;

a spring-biased contact carrier having a normal off position and being movable in a first direction only against its spring to an on position;

a movable contact coupled to said contact carrier for movement from an open position to a contacts closed position with respect to said stationary contacts when said contact carrier is moved from its off to its on position;

a spring-biased manual operating member having a normal off position and being movable in said first direction a limited distance only against its spring to engage said contact carrier and being thereafter movable against both said springs to move the latter to its on position;

said housing also comprising means mounting said spring-biased manual operating member and said contact carrier for limited reciprocal movements in the same directions with respect to said base;

and pretravel affording means coupling said spring-biased manual operating member to said contact carrier in limited sliding, interfitting engagement to afford predetermined movement of said manual operating member in said first direction while compressing its spring followed by movement of both said manual operating member and said contact carrier further in said first direction while compressing both springs.

7. The pretravel witch defined in claim 6, wherein:

said mounting means in said housing comprises a first stop for limiting the return movement of said contact carrier to its normal off position, and a second stop for limiting the return movement of said manual operating member to its normal off position wherein it is spaced from said contact carrier a fixed pretravel distance.

8. The pretravel switch defined in claim 6, wherein:

said pretravel affording means comprises a telescopic joint terminating in an abutment between said manual operating member and said contact carrier.

9. The pretravel switch defined in claim 6, wherein:

said manual operating member is a linearly slidable trigger.

10. The pretravel switch defined in claim 6, wherein:

said pretravel affording means comprises a tongue and slot slidable coupling between said manual operating member and said contact carrier to keep them in contiguous linear sliding engagement with respect to one another.

11. The pretravel switch defined in claim 6, wherein:

said manual operating member and said contact carrier are arranged in said housing in side-by-side contiguous sliding engagement relative to one another and relative to said base;

an abutment on said contact carrier engageable by said manual operating member when its pretravel has been taken up to move said contact carrier therewith to said contacts closed position;

the contact carrier's spring being between said contact carrier and an inner wall of the housing;

and the manual operating member's spring being between said manual operating member and said inner wall of the housing and extending freely through said abutment.

* * * * *